US006082538A

United States Patent [19]

Snider et al.

[11] Patent Number: 6,082,538

[45] Date of Patent: Jul. 4, 2000

[54] TOOL ITEM CONTAINER

[75] Inventors: Gregory S. Snider, Bel Air, Md.; Gregory W. Arnold, Shreveport, La.

[73] Assignee: Black & Decker Inc., Newark, Del.

[21] Appl. No.: 09/369,411

[22] Filed: Aug. 5, 1999

[51] Int. Cl.[7] ..... B65D 85/00

[52] U.S. Cl. ..... 206/372; 206/379

[58] Field of Search ..... 206/372, 373, 206/379, 486, 775, 370

[56] References Cited

U.S. PATENT DOCUMENTS 5,242,050 9/1993 Billings ..... 206/373 X
5,687,844 11/1997 Budest ..... 206/372

*Primary Examiner*—Jacob K. Ackun
*Attorney, Agent, or Firm*—Harness, Dickey & Pierce, P.L.C.

[57] ABSTRACT

A container (10) adapted for holding, storing, and dispensing various elongated tool bits (28) or other such tool items includes a base (12) with a hinged cover (18) that is substantially completely enclosed within the base (12) when the hinge cover (18) is pivoted to its fully open position by way of a hinge assembly (36, 38) that is also substantially completely unclosed within the base (12). Provisions are made for substantially preventing or at least minimizing any tendency of the tool items (28) to fall or slide loose from their respective tool item receptacles (24) when the container (10) is tipped or inverted. In addition, the tool item receptacles (24) include a number of flats (60) therein for grippingly and releasingly receiving the tool items (28). Such tool item receptacles (24) are also configured to have a large draft angle (64) on their exterior surfaces within a hollow interior space in the base (12) in order to facilitate the ease of removal of a base (12) during injection molding or other forming.

44 Claims, 5 Drawing Sheets

TOOL ITEM CONTAINER

BACKGROUND AND SUMMARY OF THE INVENTION

The present invention relates generally to containers for holding and storing various tool or other such items, and more particularly to such containers adapted for holding and storing elongated tool items, such as drill bits, driver bits, and the like, as well as chucks or extensions for such bits. In addition, the present invention relates to such containers that are adapted to be placed on a work surface or hung or suspended on a hook or other elongated external member, while providing convenient access to, and dispensing of, the tool items in the container.

Various display and storage chests, boxes, cases, and other such containers have been provided in the past for holding, storing, and dispensing tool items, such as drill bits, driver bits, or other similar elongated tool items. Frequently, such containers have included a base portion with some sort of hinged cover movable between closed and open positions in order to contain or provide access to the contents. However, many of such previous containers have presented various disadvantages, such as their inability to sufficiently grip the tool items so they do not fall out of their tool bit receptacles when the case or container is tipped or turned sideways or upside down. Other disadvantages of such prior containers include hinged covers that when opened are unsightly, occupy too much space, or inordinately interfere with work operations being performed nearby. In addition, such previous cases have often had exposed, external hinges for the hinged cover that are unsightly and easily broken or damaged while performing work operations in the vicinity of the container, as well as potentially interfering with such operations. Finally, such previous containers have often been difficult, time-consuming or unduly expensive to injection mold or otherwise produce.

The present invention seeks to overcome the disadvantages of the previous containers as outlined above. Accordingly, a container for holding a plurality of elongated tool items includes a base and a hinged cover, with the base having a first or lower base portion with a plurality of tool item openings for removably receiving one or more tool items and a second or upper base portion protruding from the first base portion and to form a generally L-shaped configuration. The hinged cover includes at least one and preferably two stop tabs protruding from an edge area such that when the cover is pivotally moved between its fully closed position with the stop tab or tabs abutting the second or upper base portion and a fully open position wherein the stop tabs abut the first or lower base portion, the cover is maintained in its proper position and orientation. In a preferred form of the invention, the first or lower base portion has an elongated cover-receiving opening formed adjacent its edges such that the cover is substantially completely enclosed within the first or lower base portion when in the fully open position. The preferred hinge assembly for pivotally interconnecting the cover and the base resides within a hollow interior space in the base so that the hinge is substantially enclosed within the interior of the first or lower base portion and protected from damage therein. By way of these arrangements, the hinge and cover are protected within the lower base portion so they cannot be easily damaged during the course of performing work operations in the vicinity of the cover, as well as being out of the way in order to avoid interfering with such work operations.

The preferred cover has at least one discontinuity, preferably in the form of an elongated rib, extending along a portion of its inside surface in order to provide an interference that minimizes or substantially eliminates small tool items housed within the container from sliding out of the tool item openings when the container is turned sideways or upside down. In addition, the cover is preferably transparent or at least translucent or semi-transparent so that the tool items are at least partially visible when the cover is in its closed position.

As mentioned above, the preferred first or lower base portion is at least partially hollow and includes a plurality of generally cylindrical hollow protrusions that extend generally inwardly into the interior space, with the hollow cylindrical protrusions opening into the exterior side of the base and thus serving as receptacles for the tool items in the first or lower base portion. These hollow cylindrical tool item-receiving protrusions each include at least one and preferably two or more flat interior surfaces extending longitudinally within the hollow cylinder and generally parallel to the cylinder's centerline axis in order to grippingly engage tool items having a wide variety of cross-sectional shapes. In addition, the exterior surface of such generally cylindrical hollow protrusions preferably converge from a relatively larger exterior diameter portion generally adjacent the interior surface of the first or lower base portion to a relatively smaller exterior diameter portion generally adjacent the free end wall of the hollow cylindrical protrusion. This results in the exterior surface of each of the cylinder walls intersecting the interior surface of the first or lower base portion at a draft angle of greater than 90 degrees. Such improved draft angle is highly advantageous during the injection molding or other such production methods used to manufacture the container according to the present invention. Finally, the preferred base includes a number of gauging or sizing openings formed therein for gauging or sizing drill bits, driver bits, or other tool items. Such gauging openings are preferably located on the first or lower base portion in such a position to be exposed regardless of the open or closed position of the hinged pivotal cover.

Additional objects, advantages, and features of the present invention will become apparent from the following description and the appended claims, taken in conjunction with the accompanying drawings.

DETAILED DESCRIPTION OF THE PREFERRED EMBODIMENTS

FIGS. 1 through 10D illustrate a preferred exemplary embodiment of a tool items container according to the present invention, shown for purposes of illustration. One skilled in the art will readily recognize from the following discussion, and from the accompanying drawings and claims, that the principles of the present invention are equally applicable to other tool item containers adapted for holding, storing and dispensing a wide variety of tool items or tool bits.

Figure 1:
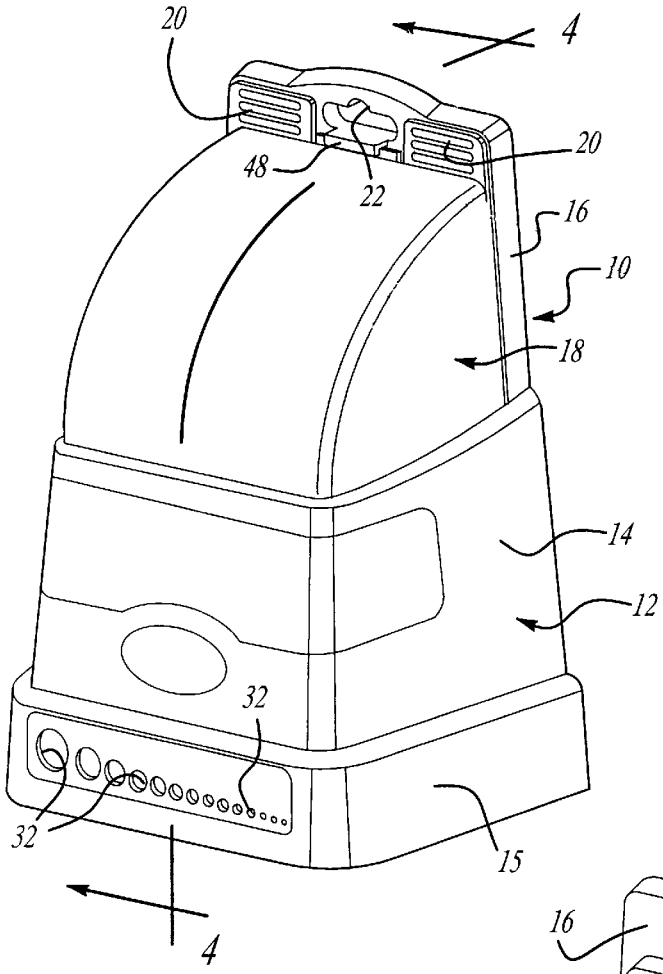
FIG. 1 is front and top perspective view of an exemplary tool item container according to the present invention, shown with its hinged cover in the fully closed position.
Figure 2:
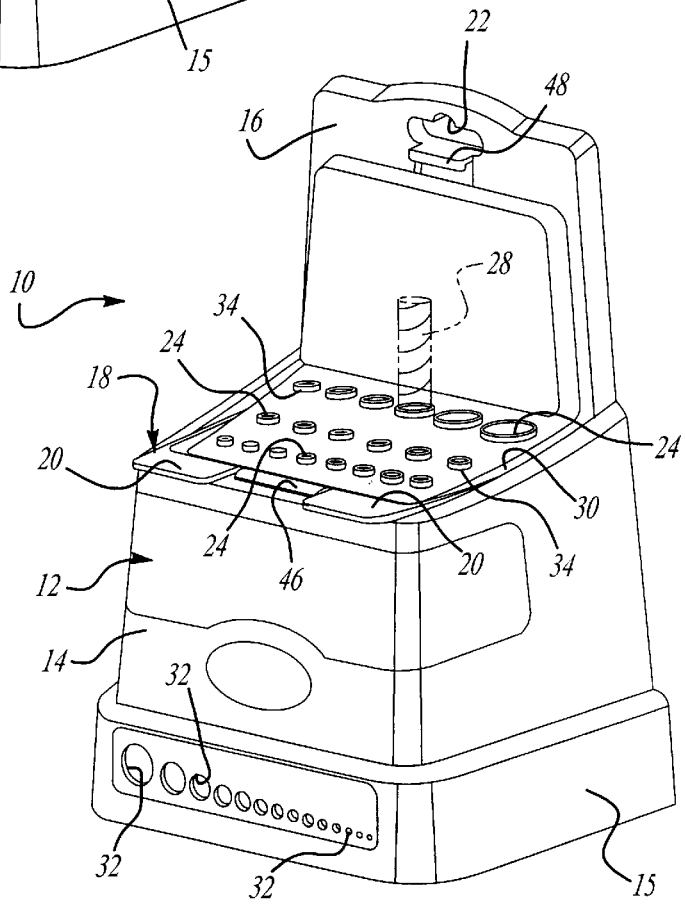
FIG. 2 is a perspective view similar to that of FIG. 1, but illustrating the hinged cover in its fully open position.
Figure 3:
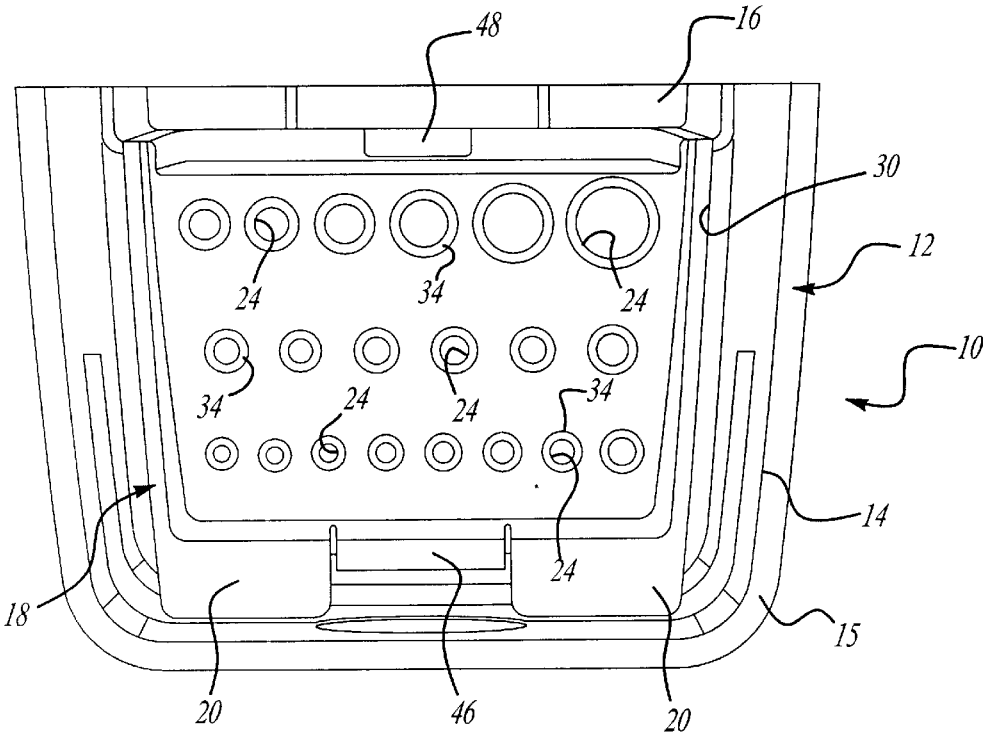
FIG. 3 is a top view of the tool item container of FIGS. 1 and 2, shown with the hinged cover in its fully opened position.

FIGS. 1 and 2 illustrate, in perspective views, a tool item container 10 having a base 12 and a cover 18, with the cover shown in closed and open positions, respectively. The base 12 preferably includes a lower base portion with side walls that slope outwardly and downwardly to a preferred enlarged pod portion in order to provide enhanced stability for the tool item container. In addition, the preferred upper base portion 16 includes a hang-hole 22 so that the tool item container 10 can alternatively be suspended or hung from a peg, hook, or other such elongated external member. An upper base portion 16 protrudes in a generally upward direction from the lower base portion 14, such that together the upper and lower base portions 14 and 16 are arranged in a generally L-shaped configuration when viewed from either side of the tool item container 10.

The cover 18 is pivotally interconnected with the base 12 and preferably includes one or more stop tabs 20 that engage the upper base portion 16 and the lower base portion 14 when in its respective fully closed and fully opened positions.

The lower base portion 14 includes a number of tool item or tool bit openings 24 formed therein, for grippingly receiving drill bits 28 or other such elongated tool or bit items. The lower base portion 14 also includes a cover-receiving slot or opening 30 formed therein in a partially surrounding relationship with the tool item or tool bit openings 24 to receive the cover 18 as it is pivotally moved from its closed position, illustrated in FIGS. 1 and 4, to its fully open position, illustrated in FIGS. 2 and 5. In addition, the lower base portion 14 preferably includes a boss 34 protruding upwardly therefrom and surrounding each of the tool bit openings 24 in order to provide enhanced support and to assist in preventing the tool items from falling or sliding free from their respective tool bit openings 24 when the tool item container 10 is tipped, turned sideways, or held in an inverted, upside-down orientation. The lower base portion 14 also preferably includes a number of gauging or sizing openings 32, which are exposed and accessible regardless of the open or closed position of the cover 18, and which assist the user in determining sizes of drill bits or other tool items.

Figure 6:
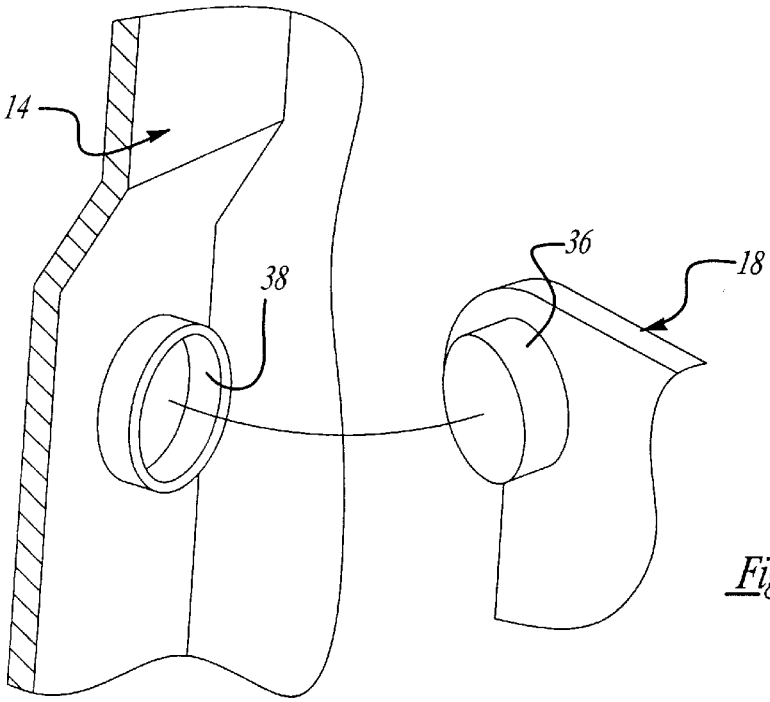
FIG. 6 is a detailed partial exploded view, illustrating the hinge assembly for the cover of the tool item container of FIGS. 1 through 5.
Figure 7:
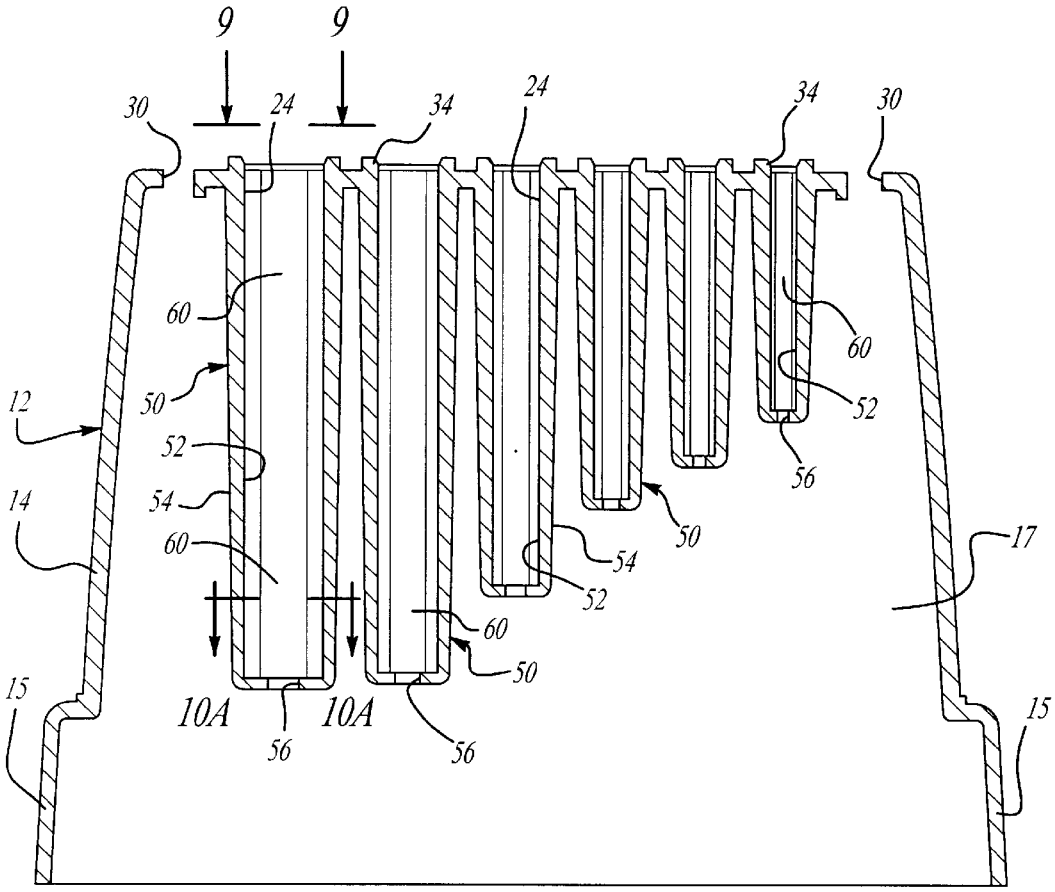
FIG. 7 is a cross-sectional view of the lower base portion of the tool item container, taken generally along line 7—7 of FIG. 4, but with the hinged cover removed for clarity.
Figure 8:
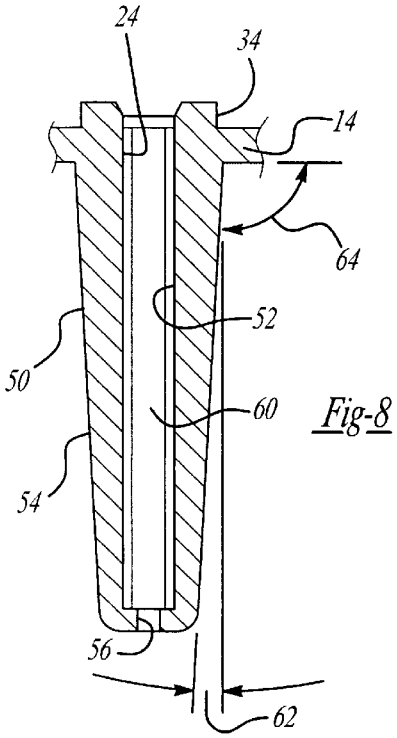
FIG. 8 is a detailed cross-sectional view of a typical or exemplary cylindrical protrusion of FIG. 7, but with the shape of the protrusion and the angle with which it intersects the lower interior surface of the lower base portion shown in exaggerated form.

As illustrated in FIG. 6, the cover 18 is pivotably interconnected with the lower base portion 14 by way of a hinge pin on the exterior of the cover 18, which is snapped or otherwise inserted into a hinge socket 38 on an interior surface of the lower base portion 14 in order to pivotally interconnect the cover 18 with the lower base portion 14. It should be noted that the positions of the hinge pin 36 and the hinge socket 38 can alternatively be reversed, with the hinge pin 36 being positioned on the interior surface of the lower base portion 14 and correspondingly with the hinge socket 38 being located on an exterior surface of the cover 18.

Figure 4:
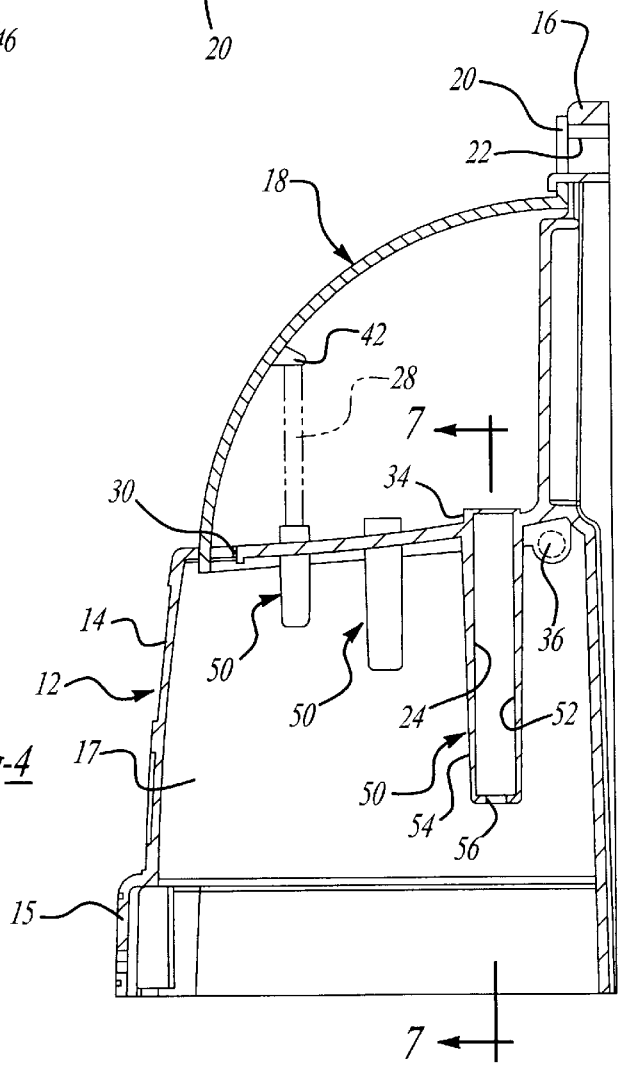
FIG. 4 is a cross-sectional view taken generally along line 4—4 of FIG. 1.
Figure 5:
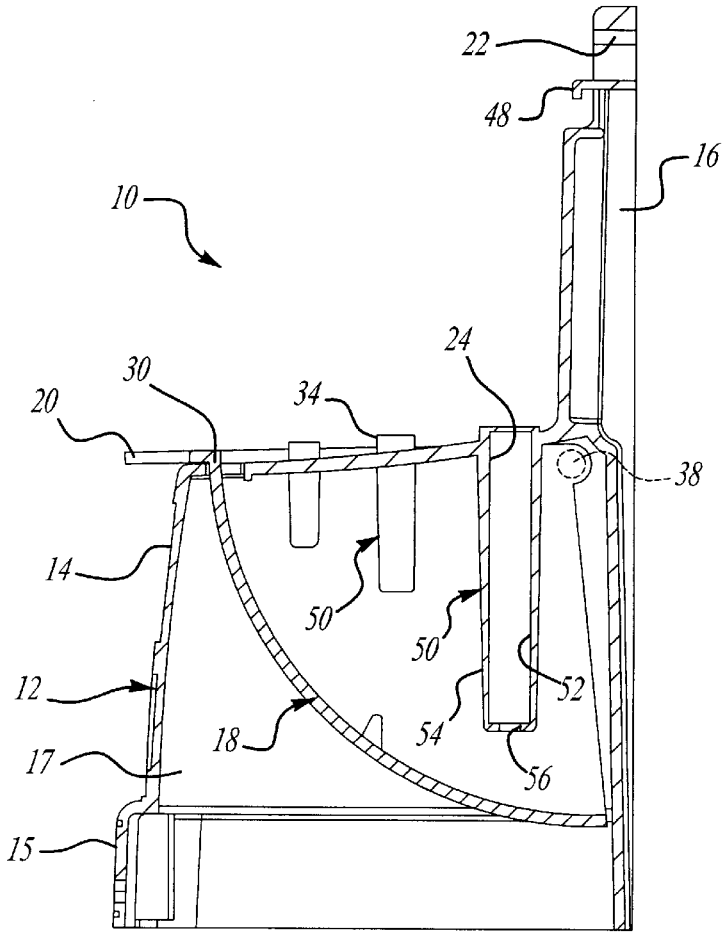
FIG. 5 is a cross-sectional view similar to that of FIG. 4, but illustrating the tool item container with its hinged cover in the fully opened position.

As is perhaps best illustrated in FIG. 4, the cover 18 preferably includes one or more elongated discontinuities or ribs 42, which substantially prevent or at least minimize the tendency of a tool item 28 sliding or falling free from its respective tool item opening 24 when the tool item container 10 is tipped or inverted. This feature is further enhanced by the provision of the above-mentioned bosses 34 surrounding the tool item openings 24, such that the vertical distance between the rib or ribs 42 and one or more of the bosses 34 is longer than the length of the smallest tool item intended to be held or stored in the tool item container 10.

As shown in FIG. 4, the cover 18 also preferably includes a latch 46, which is snappingly and releasably engageable with a latch tab 48 on the upper base portion 16. Such latch assembly releasably retains the cover 18 in its fully closed position until it is intended to be opened by the user.

Figure 9:
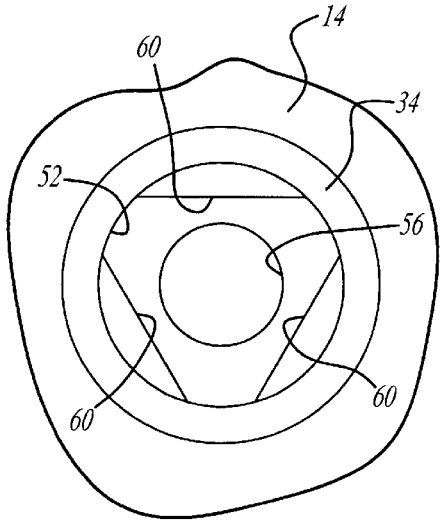
FIG. 9 is a partial detailed view of one of the tool item receptacles, looking generally in the direction of the arrows 9 of FIG. 7.
Figure 10A:
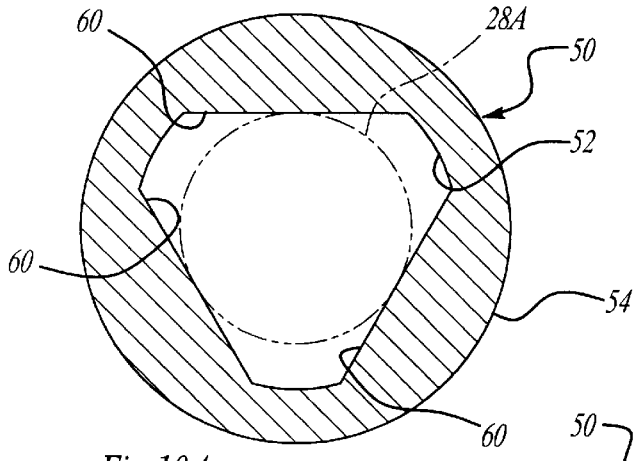
FIG. 10A is a cross-sectional view taken generally along line 10A–10A of FIG. 7, illustrating the accommodation of tool items with shanks of a round cross-sectional shape.
Figure 10B:
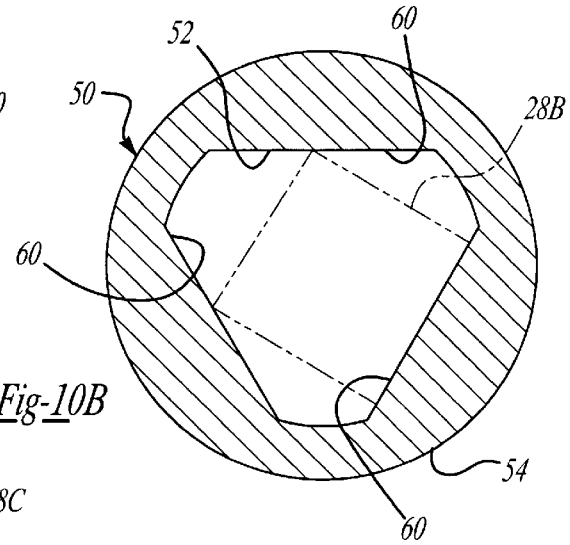
FIG. 10B is a view similar to FIG. 10A, but illustrating the accommodation of tool items with square shanks.
Figure 10C:
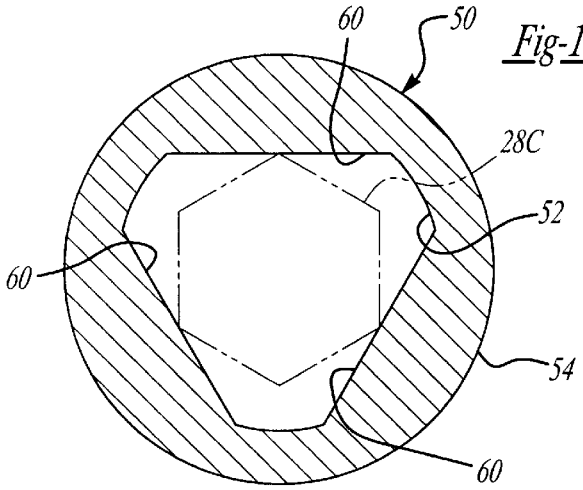
FIG. 10C is a cross-sectional view similar to that of FIGS. 10A and 10B, but illustrating the accommodation of tool items with hexagonal shanks.
Figure 10D:
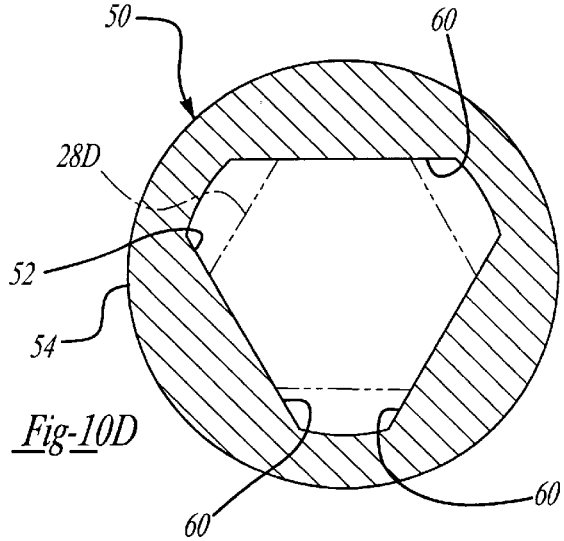
FIG. 10D is a cross-sectional view similar to that of FIGS. 10A through 10C, but illustrating yet another accommodation of tool items having hex-shaped shanks.

As is perhaps best illustrated in FIGS. 7 through 10D, the tool item openings 24 are provided by way of generally cylindrical hollow protrusions 50 that protrude into the at least partially hollow interior space of the preferred lower base portion 14. The inner cylindrical wall 52 of each of the protrusions 50 is provided with one or more, and preferably three, flats 60 that extend longitudinally for at least a substantial portion of the longitudinal or axial length of the generally cylindrical protrusions 50. As is illustrated in FIG. 9 through FIG. 10D, the flat 60 provide for a secure releasable gripping engagement with tool items inserted into the tool item openings 24 and are capable of accommodating tool bits or items having a wide variety of cross-sectional shank shapes. In addition, a hole or opening 56 is preferably provided in the bottom, free end wall of the generally cylindrical protrusions 50 in order to prevent the accumulation of dust, chips or other debris within the tool item openings 24.

The preferred generally cylindrical protrusions 50 also include an outer cylindrical wall surface 54 shaped such that the exterior diameter of each protrusion 50 converges to a smaller exterior diameter generally adjacent the bottom wall of the generally cylindrical protrusion 50. This results in a convergence angle illustrated in exaggerated form and indicated by reference numeral 62 in FIG. 8, as well as increased or improved draft angle 64 formed between the outer or exterior cylindrical wall surface 54 of each protrusion 50 with the lower interior surface of the lower base portion 14. The draft angle 64 is preferably substantially greater than 90 degrees, as is illustrated in exaggerated form in FIG. 8. Such improved draft angle greatly simplifies and improves the ease of withdrawing an injection molded base 12 from the mold during production and manufacturing of the tool item container 10.

The foregoing discussion discloses and describes merely exemplary embodiments of the present invention for purposes of illustration only. One skilled in the art will readily recognize from such discussion, and from the accompanying drawings and claims, that various changes, modifications and variations can be made therein without departing from the spirit and scope of the invention as defined in the following claims.

We claim:

1. A container for holding a plurality of elongated tool items, said container having a base and a cover, said base having a first base portion with a plurality of tool item openings therein for removably receiving one or more of the tool items and a second base portion protruding from said first base portion, said first and second base portions being in a generally L-shaped configuration with respect to each other, said cover having at least one stop tab protruding therefrom and being pivotally movable between a fully closed position wherein said stop tab abuts said second base portion with said cover covering said tool item openings to enclose the tool items inserted therein and a fully open position wherein said stop tab is adjacent said first base portion with said tool bit openings exposed to allow insertion and removal of the tool items into and from said tool item openings, respectively, said first base portion having an elongated cover-receiving opening therein, said cover being substantially completely enclosed within said first base portion when said cover is in said fully open position.

2. A container according to claim 1, wherein said cover is at least partially transparent so that said tool item openings are at least partially visible when said cover is in said fully closed position.

3. A container according to claim 1, further including at least one hinge assembly for pivotally interconnecting said cover and said base, said first base portion being at least partially hollow to define an interior space therein, said hinge being substantially enclosed within said interior space of said first base portion.

4. A container according to claim 1, wherein said cover has at least one discontinuity on an inside surface thereof, said discontinuity protruding inwardly from said inside surface toward at least one of said tool item openings in said first base portion and being generally aligned with said at least one of said tool item openings when said cover is in said fully closed position in order to substantially restrain one of the tool items within said one of said tool item openings.

5. A container according to claim 4, wherein said discontinuity is an elongated rib extending along a portion of said inside surface of said cover and protruding generally inwardly therefrom, said elongated rib being generally aligned with a row of said tool item openings.

6. A container according to claim 1, wherein said first base portion has a plurality of tool item size-gauging openings formed therein.

7. A container according to claim 6, wherein said size-gauging openings are exposed and accessible regardless of the position of said cover.

8. A container according to claim 1, wherein said second base portion has at least one hang-hole formed therein to allow said container to be hung on an external elongated member.

9. A container according to claim 1, wherein said container further includes a latch assembly for releasably securing said cover to said second base portion when said cover is in said fully closed position.

10. A container according to claim 1, wherein said first base portion is at least partially hollow to define an interior space therein, said first base portion having a plurality of generally cylindrical hollow protrusions extending generally inwardly therefrom into said interior space therein to define respective ones of said tool item openings extending longitudinally inwardly therein from an exterior side of said first base portion, each of said tool item openings being generally surrounded by a cylinder wall portion of its respective hollow cylindrical protrusion, and each of said cylinder walls having at least one flat interior surface therein extending longitudinally within said respective tool item opening in order to grippingly engage a tool item inserted therein.

11. A container according to claim 10, wherein each of said cylinder walls has three of said flat interior surfaces therein.

12. A container according to claim 10, wherein the exterior surface of each of said cylinder walls converges from a larger exterior diameter generally adjacent an interior surface of said first base portion to a smaller exterior diameter generally adjacent a free end wall of said hollow cylindrical protrusion.

13. A container according to claim 12, wherein said exterior surface of each of said cylinder walls intersects said interior surface of said first base portion at an angle of greater than 90 degrees.

14. A container according to claim 13, wherein each of said cylinder walls has three of said flat interior surfaces therein.

15. A container according to claim 14, wherein said flat interior surfaces are spaced circumferentially around and within the respective tool item opening.

16. A container according to claim 1, wherein each of said tool item openings is surrounded by a raised boss on an exterior surface of said first base portion.

17. A container according to claim 1, wherein said tool item openings are adapted to grippingly receive tool items having generally cylindrical shank portions.

18. A container according to claim 1, wherein said tool item openings are adapted to grippingly receive tool items having generally square shank portions.

19. A container according to claim 1, wherein said tool item openings are adapted to grippingly receive tool items having generally hexagonal shank portions.

20. A container according to claim 1, wherein said tool items are drill bits, said first base portion having a plurality of drill bit gauging openings formed therein, said gauging openings being exposed and accessible regardless of the position of said cover.

21. A container for holding a plurality of elongated tool items, said container having a base and a cover, said base having a first base portion with a plurality of tool item openings therein for removably receiving one or more of the tool items and a second base portion protruding from said first base portion, said first and second base portions being in a generally L-shaped configuration with respect to each other, said cover being pivotally movable between a fully closed position with said cover covering said tool item openings to enclose the tool items inserted therein and a fully open position with said tool bit openings exposed to allow insertion and removal of the tool items into and from said tool item openings, respectively, said first base portion being at least partially hollow to define an interior space therein, said first base portion having a plurality of generally cylindrical hollow protrusions extending generally inwardly therefrom into said interior space therein to define respective ones of said tool item openings extending longitudinally inwardly therein from an exterior side of said first base portion, each of said tool item openings being generally surrounded by a cylinder wall portion of its respective hollow cylindrical protrusion, and each of said cylinder walls having three flat interior surfaces therein extending longitudinally and spaced circumferentially within said respective tool item opening in order to grippingly engage a tool item inserted therein, the exterior surface of each of said cylinder walls converging from a larger exterior diameter generally adjacent an interior surface of said first base portion to a smaller exterior diameter generally adjacent a free end wall of said hollow cylindrical protrusion, said exterior surface of each of said cylinder walls intersecting said interior surface of said first base portion at an angle of greater than 90 degrees.

22. A container according to claim 21, wherein each of said tool item openings is surrounded by a raised boss on an exterior surface of said first base portion.

23. A container according to claim 21, wherein said tool item openings are adapted to grippingly receive tool items having generally cylindrical shank portions.

24. A container according to claim 21, wherein said tool item openings are adapted to grippingly receive tool items having generally square shank portions.

25. A container according to claim 21, wherein said tool item openings are adapted to grippingly receive tool items having generally hexagonal shank portions.

26. A container according to claim 21, wherein said tool items are drill bits, said first base portion having a plurality of drill bit gauging openings formed therein, said gauging openings being exposed and accessible regardless of the position of said cover.

27. A container for holding a plurality of elongated tool items, said container having a base and a cover, said base having a first base portion with a plurality of tool item openings therein for removably receiving one or more of the tool items and a second base portion protruding from said first base portion, said first and second base portions being in a generally L-shaped configuration with respect to each other, said cover having at least one stop tab protruding therefrom and being pivotally movable between a fully closed position wherein said stop tab abuts said second base portion with said cover covering said tool item openings to enclose the tool items inserted therein and a fully open position wherein said stop tab is adjacent said first base portion with said tool bit openings exposed to allow insertion and removal of the tool items into and from said tool item openings, respectively, said first base portion having an elongated cover-receiving opening therein, said cover being substantially completely enclosed within said first base portion when said cover is in said fully open position, said container further including at least one hinge assembly for pivotally interconnecting said cover and said base, said first base portion being at least partially hollow to define an interior space therein, said hinge being substantially enclosed within said interior space of said first base portion, said first base portion having a plurality of generally cylindrical hollow protrusions extending generally inwardly therefrom into said interior space therein to define respective ones of said tool item openings extending longitudinally inwardly therein from an exterior side of said first base portion, each of said tool item openings being generally surrounded by a cylinder wall portion of its respective hollow cylindrical protrusion, and each of said cylinder walls having at least one flat interior surface therein extending longitudinally within said respective tool item opening in order to grippingly engage a tool item inserted therein, the exterior surface of each of said cylinder walls converging from a larger exterior diameter generally adjacent an interior surface of said first base portion to a smaller exterior diameter generally adjacent a free end wall of said hollow cylindrical protrusion, and said exterior surface of each of said cylinder walls intersecting said interior surface of said first base portion at an angle of greater than 90 degrees.

28. A container according to claim 27, wherein each of said cylinder walls has three of said flat interior surfaces therein, said flat interior surfaces being spaced circumferentially around and within the respective tool item opening.

29. A container according to claim 28, wherein each of said tool item openings is surrounded by a raised boss on an exterior surface of said first base portion.

30. A container according to claim 28, wherein said tool item openings are adapted to grippingly receive tool items having generally cylindrical shank portions.

31. A container according to claim 28, wherein said tool item openings are adapted to grippingly receive tool items having generally square shank portions.

32. A container according to claim 28, wherein said tool item openings are adapted to grippingly receive tool items having generally hexagonal shank portions.

33. A container according to claim 28, wherein said tool items are drill bits, said first base portion having a plurality of drill bit gauging openings formed therein, said gauging openings being exposed and accessible regardless of the position of said cover.

34. A container for holding a plurality of elongated tool items, said container having a base and a cover, said base having a first base portion with a plurality of tool item openings therein for removably receiving one or more of the tool items and a second base portion protruding from said first base portion, said first and second base portions being in a generally L-shaped configuration with respect to each other, said cover having at least one stop tab protruding therefrom and being pivotally movable between a fully closed position wherein said stop tab abuts said second base portion with said cover covering said tool item openings to enclose the tool items inserted therein and a fully open position wherein said stop tab is adjacent said first base portion with said tool bit openings exposed to allow insertion and removal of the tool items into and from said tool item openings, respectively, said first base portion having an elongated cover-receiving opening therein, said cover being substantially completely enclosed within said first base portion when said cover is in said fully open position, said container further including at least one hinge assembly for pivotally interconnecting said cover and said base, said first base portion being at least partially hollow to define an interior space therein, said hinge being substantially enclosed within said interior space of said first base portion, said cover having at least one elongated rib extending along an inside surface thereof, said rib protruding inwardly from said inside surface toward said tool item openings in said first base portion and being generally aligned with a row of said tool item openings when said cover is in said fully closed position in order to substantially restrain one of the tool items within said one of said tool item openings, and said container further including a latch assembly for releasably securing said cover to said second base portion when said cover is in said fully closed position.

35. A container according to claim 34, wherein said cover is at least partially transparent so that said tool item openings are at least partially visible when said cover is in said fully closed position.

36. A container according to claim 35, wherein said second base portion has at least one hang-hole formed therein to allow said container to be hung on an external elongated member.

37. A container according to claim 36, wherein said first base portion has a plurality of tool item size-gauging openings formed therein.

38. A container according to claim 37, wherein said size-gauging openings are exposed and accessible regardless of the position of said cover.

39. A container for holding a plurality of elongated tool items, said container having a base and a cover, said base having a first base portion with a plurality of tool item openings therein for removably receiving one or more of the tool items and a second base portion protruding from said first base portion, said first and second base portions being in a generally L-shaped configuration with respect to each other, said cover having at least one stop tab protruding therefrom and being pivotally movable between a fully closed position wherein said stop tab abuts said second base portion with said cover covering said tool item openings to enclose the tool items inserted therein and a fully open position wherein said stop tab is adjacent said first base portion with said tool bit openings exposed to allow insertion and removal of the tool items into and from said tool item openings, respectively, said first base portion having an elongated cover-receiving opening therein, said cover being substantially completely enclosed within said first base portion when said cover is in said fully open position, said cover being at least partially transparent so that said tool item openings are at least partially visible when said cover is in said fully closed position, said container further including at least one hinge assembly for pivotally interconnecting said cover and said base, said first base portion being at least partially hollow to define an interior space therein, said hinge being substantially enclosed within said interior space of said first base portion, said cover having at least one elongated rib extending along an inside surface thereof, said rib protruding inwardly from said inside surface toward at least one of said tool item openings in said first base portion and being generally aligned with a row of said tool item openings when said cover is in said fully closed position in order to substantially restrain one of the tool items within said one of said tool item openings, said first base portion having a plurality of tool item size-gauging openings formed therein, said size-gauging openings being exposed and accessible regardless of the position of said cover, said second base portion having at least one hang-hole formed therein to allow said container to be hung on an external elongated member, said container further including a latch assembly for releasably securing said cover to said second base portion when said cover is in said fully closed position, said first base portion having a plurality of generally cylindrical hollow protrusions extending generally inwardly therefrom into said interior space therein to define respective ones of said tool item openings extending longitudinally inwardly therein from an exterior side of said first base portion, each of said tool item openings being generally surrounded by a cylinder wall portion of its respective hollow cylindrical protrusion, and each of said cylinder walls having three flat interior surfaces therein extending longitudinally and spaced circumferentially within said respective tool item opening in order to grippingly engage a tool item inserted therein, the exterior surface of each of said cylinder walls converging from a larger exterior diameter generally adjacent an interior surface of said first base portion to a smaller exterior diameter generally adjacent a free end wall of said hollow cylindrical protrusion, and said exterior surface of each of said cylinder walls intersecting said interior surface of said first base portion at an angle of greater than 90 degrees.

40. A container according to claim 39, wherein each of said tool item openings is surrounded by a raised boss on an exterior surface of said first base portion.

41. A container according to claim 40, wherein said tool item openings are adapted to grippingly receive tool items having generally cylindrical shank portions.

42. A container according to claim 40, wherein said tool item openings are adapted to grippingly receive tool items having generally square shank portions.

43. A container according to claim 40, wherein said tool item openings are adapted to grippingly receive tool items having generally hexagonal shank portions.

44. A container according to claim 40, wherein said tool items are drill bits, said first base portion having a plurality of drill bit gauging openings formed therein, said gauging openings being exposed and accessible regardless of the position of said cover.

* * * * *

UNITED STATES PATENT AND TRADEMARK OFFICE
Certificate

Patent No. 6,082,538 Patented: July 4, 2000

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Gregory S. Snider, Bel Air, MD; Gregory W. Arnold, Shreveport, LA; and James Pangerc, Parkville, MD.

Signed and Sealed this Sixteenth Day of November 2004.

MICKEY YU
*Supervisory Patent Examiner*
Art Unit 3728